US005567104A

United States Patent [19]

Focke et al.

[11] Patent Number: 5,567,104

[45] Date of Patent: Oct. 22, 1996

[54] APPARATUS FOR THE TRANSPORT AND STOCKING OF CIGARETTES

[75] Inventors: Heinz Focke; Harald Gosebruch, both of Verden; Hans-Jurgen Bretthauer, Bremen, all of Germany

[73] Assignee: Focke & Co. (GmbH & Co.), Verden, Germany

[21] Appl. No.: 199,872

[22] Filed: Feb. 22, 1994

[30] Foreign Application Priority Data

Feb. 23, 1993 [DE] Germany ..... 43 05 464.1

[51] Int. Cl.[6] ..... B65G 1/10

[52] U.S. Cl. ..... 414/331; 53/242; 414/403; 131/282; 198/347.3

[58] Field of Search ..... 198/347.3; 131/282, 131/283; 414/331, 403, 416, 417, 608, 269, 270, 271, 272; 53/420, 444, 467, 473, 475, 476, 148, 242, 249, 250, 236, 376.3

[56] References Cited

U.S. PATENT DOCUMENTS

| | | | |
|---|---|---|---|
| 753,223 | 3/1904 | Beeg | 53/242 X |
| 1,738,569 | 12/1929 | Fuller . | |
| 3,593,487 | 7/1971 | Cleland | 53/242 X |
| 3,655,080 | 4/1972 | Gianese | 414/403 X |
| 3,967,740 | 7/1976 | Mollins | 414/331 |
| 4,056,916 | 11/1977 | Seragnoli | 198/347.3 |
| 4,170,285 | 10/1979 | Hinchcliffe | 198/347.3 |
| 4,181,212 | 1/1980 | Hinchcliffe | 414/331 |
| 4,220,236 | 9/1980 | Blidung et al. | 198/347.3 |
| 4,403,908 | 9/1983 | Cartoceti | 414/403 |
| 4,995,769 | 2/1991 | Berger et al. . | |
| 5,088,589 | 2/1992 | Geerts . | |
| 5,123,798 | 6/1992 | Glosmänn et al. | 414/403 |
| 5,348,436 | 9/1994 | Hogenkamp et al. | 414/331 |

FOREIGN PATENT DOCUMENTS

| | | | |
|---|---|---|---|
| 334115 | 9/1989 | European Pat. Off. | 131/282 |
| 336897 | 10/1989 | European Pat. Off. . | |
| 2168120 | 8/1973 | France . | |
| 1127810 | 12/1960 | Germany . | |
| 7200446 | 1/1972 | Germany . | |
| 2323079 | 10/1976 | Germany . | |
| 2636163 | 2/1977 | Germany . | |
| 2900778 | 7/1979 | Germany . | |
| 3322302 | 12/1983 | Germany . | |
| 3638538 | 5/1988 | Germany . | |
| 8630229 | 11/1988 | Germany . | |
| 2265808 | 8/1989 | Germany . | |
| 273045 | 11/1989 | Germany . | |
| 2004829 | 4/1979 | United Kingdom . | |
| 2017618 | 10/1979 | United Kingdom . | |
| 2061216 | 5/1981 | United Kingdom | 198/347.3 |
| 2072119 | 9/1981 | United Kingdom | 414/403 |
| 2142894 | 1/1985 | United Kingdom . | |

OTHER PUBLICATIONS

JP 56 93623 A. In: Patent Abstracts of Japan, M94, Oct. 29, 1981, vol. 5, No. 170.

*Primary Examiner*—Frank E. Werner

*Attorney, Agent, or Firm*—Sughrue, Mion, Zinn, Macpeak & Seas

[57] ABSTRACT

For high-performance packaging machines, a correspondingly large stock of cigarettes must be supplied. A container magazine (11 ) serves for receiving a plurality of containers (12) combined to form storage units (18). Each container receives a relatively large number of cigarettes. Filling takes place via a bottom wall (17). The storage units (18) can be moved up and down and transversely within the container magazine (11). The containers (12) are also designed in a special way, in order to guarantee fault-free filling and emptying.

21 Claims, 7 Drawing Sheets

APPARATUS FOR THE TRANSPORT AND STOCKING OF CIGARETTES

BACKGROUND OF THE INVENTION

The invention relates to an apparatus for the transport and stocking (storage) of cigarettes in a plurality of containers which are arranged next to one another and form a storage unit and which can be filled in a filling station by means of a filling member, in particular via a filling orifice formed in the region of a bottom wall. The invention relates, furthermore, to details of the design and handling of the containers receiving the cigarettes.

The handling of cigarettes after their manufacture and before packaging causes particular problems in the packaging of cigarettes. The cigarette-producing machines (makers) manufacture cigarettes with a high output of, for example, 16,000 cigarettes per minute. A relatively large number of cigarettes must be supplied to the packaging machine in an expedient way. At the same time, operational fluctuations in output of the cigarette-producing machine and of the following packaging machine have to be taken into account. It is therefore customary to place storage devices for cigarettes in the region between the two units. Depending on the fluctuations in output, cigarettes are conveyed into this store or dispensed from it.

So-called trestles are known for the stocking and transport of cigarettes, namely containers which are open on two sides and which serve for receiving cigarette stock. The trestles are conventionally moved to the place of use on carriages and are emptied by tipping in the region of a cigarette magazine of a packaging machine.

However, there is also already a known store with a plurality of vertical containers which are connected to form a storage unit and which each serve for receiving a cigarette stock. These containers are filled with cigarettes from above and are emptied via a lower extraction orifice (DE 2,900,778).

SUMMARY OF THE INVENTION

Proceeding from the state of the art, the object on which the invention is based is to propose an apparatus for the storage and handling of cigarettes, which, by the use of containers for receiving a cigarette stock, has a considerably larger storage capacity and which allows easier handling during the distribution of the stored cigarettes.

To achieve this object, the apparatus according to the invention is characterized in that a plurality of storage units (units consisting of a plurality of containers) are received in a container magazine, the storage units being arranged one above the other and, if appropriate, next to one another within the container magazine in the region of at least one vertical conveyor, the storage units being capable of being fed to the filling station in succession and the individual containers of being filled or emptied in succession within the latter.

The apparatus according to the invention accordingly proceeds from storage units which each consist of a plurality of containers arranged next to one another. A plurality of storage units of this type are received in a container magazine. The storage units can be integrated fixedly into the container magazine. However, more advantageous is a handling such that the storage units can, as required, be extracted individually and severally from the container magazine or fed to the latter.

According to the invention, in the region of the container magazine, the individual containers are filled and/or emptied, preferably in the region of a stationary filling station. The containers of each storage unit are moved in succession into the filling or emptying station. For this purpose, the container magazine is equipped with cross-conveyors which allow the storage units to be transported relative to a filling or emptying member.

A further subject of the invention is the design and handling of the containers, specifically individually or as part of a storage unit.

According to the invention, to make it easier to fill and/or empty a container, during a filling (or emptying) phase, guide members for the cigarettes can be introduced into the container via an at least partially open side of the latter and can be moved out of the container gradually in conformity with the filling or emptying operation. These guide members are designed, in particular, in such a way that they form, within the container, a funnel-shaped movement cross section for the cigarettes which leads to a lower central extraction orifice. The guide members are arranged in a stationary manner and penetrate into the particular processed container only in the region of the filling or emptying station.

A further special feature of the invention relates to measures in connection with the filling and emptying of the containers, namely for the operations for the opening and closing of a filling orifice of a container. This purpose is served, according to the invention, by closing flaps of the container which, when the filling orifice is open, form a lateral limitation of the conveying channel for the cigarettes.

Further details of the invention relate to the design of a container magazine and of the individual containers and of the members associated with the filling or emptying of the containers.

Exemplary embodiments of the invention are explained in more detail below by means of the drawings. In these:

DESCRIPTION OF PREFERRED EMBODIMENTS

Figure 1:
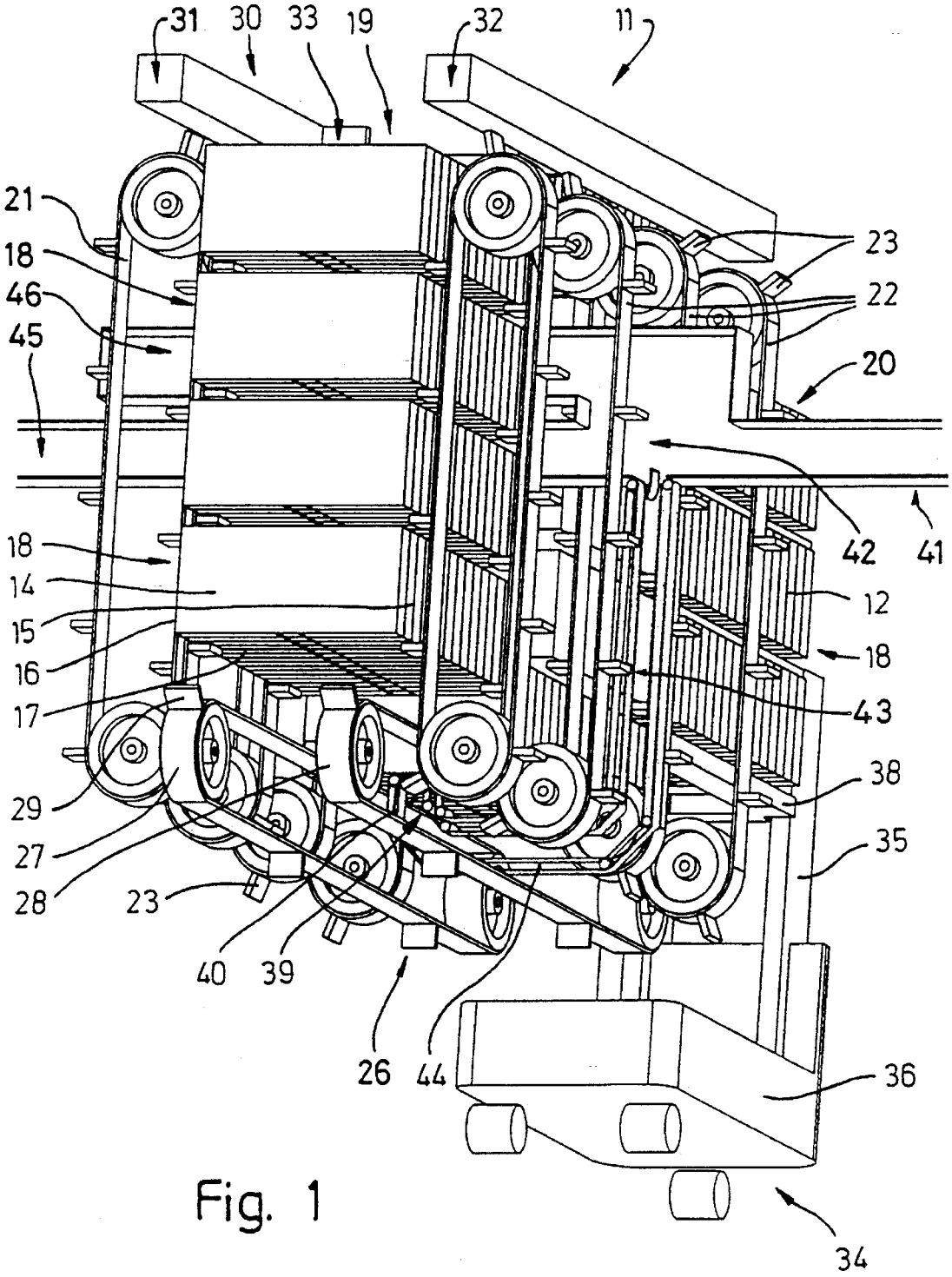
FIG. 1 shows a perspective bottom view of an apparatus for the conveyance and storage of cigarettes with a storage unit, namely a container magazine.

The exemplary embodiments illustrated in the drawings are concerned with the handling of cigarettes 10 or of other elongate bar-shaped articles. The purpose is the storage of a large number of cigarettes 10 and their transport in the region between a cigarette-producing machine and a packaging machine (neither is shown).

Figure 2:
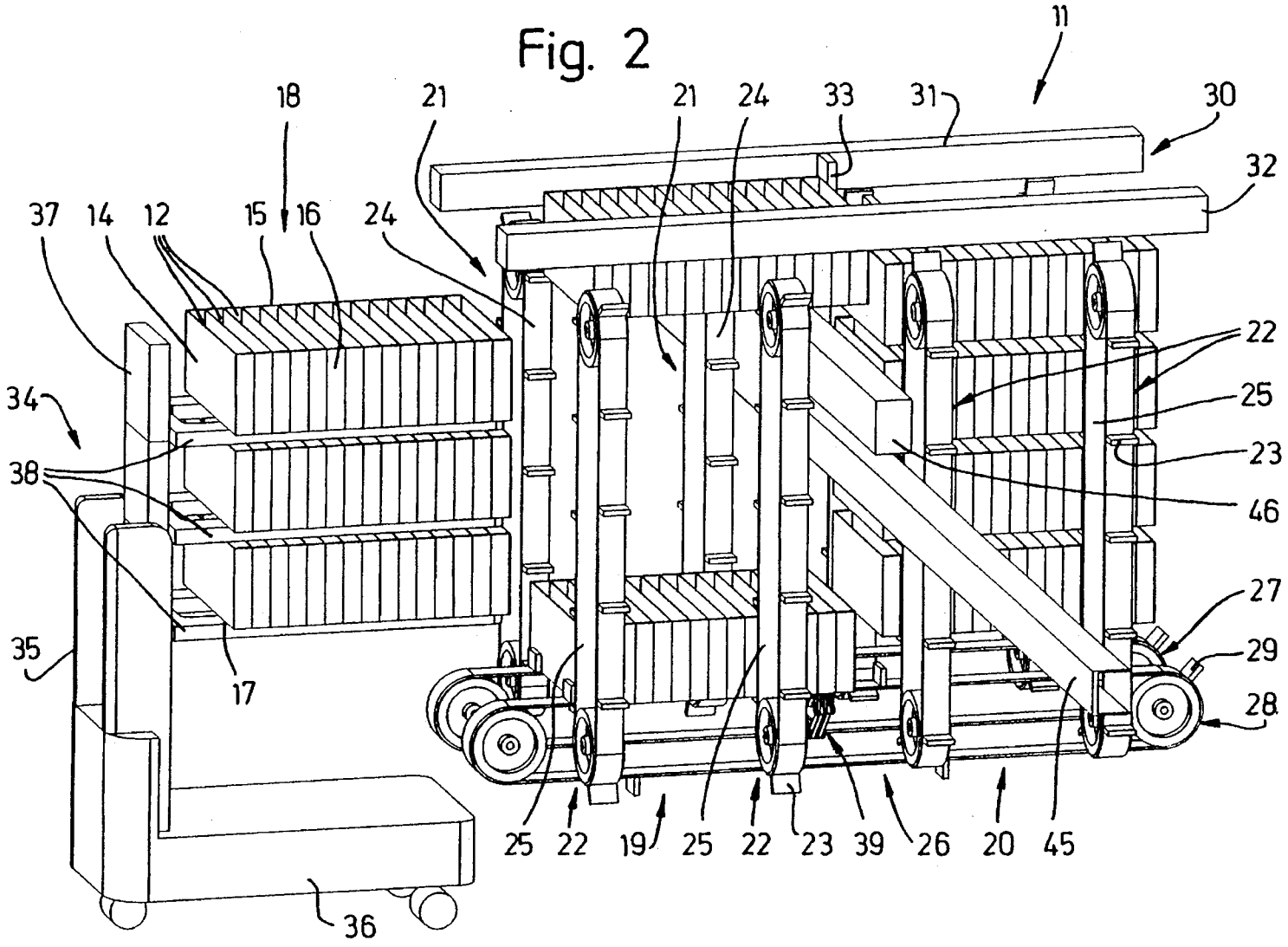
FIG. 2 shows a perspective representation of a container magazine corresponding to that of the exemplary embodiment according to FIG. 1, with a transport device for storage units.

FIGS. 1 and 2 show details of a storage apparatus of high capacity; This consists essentially of a container magazine 11 which is suitable for receiving a large number of containers 12. This will serve for receiving a relatively large cigarette stock 13 and for dispensing this. In the present case, a container 12 consists of a large-area front wall 14, of narrow vertical side walls 15 and 16 and of a bottom wall 17. As shown, on the top side, the container 12 can be open or alternatively also closed.

A plurality of containers 12 are arranged next to one another, to form a fixed group of containers 12, namely a storage unit 18. The containers 12 are arranged in such a way that the side walls 15, 16 extend in a common plane. The front walls 14 are directed transversely and each close off the open side of an adjacent container 12. This gives rise to a unit consisting of a plurality of cells or chambers divided off from one another by partition walls. The width of the said cells or chambers corresponds approximately to the length of a cigarette 10. In the present case, the storage unit 18 of this design consists of 15 containers 12 or cells. The containers 12 are rectangular, as seen in horizontal projection. The capacity of such a container 12 is approximately 6,000 cigarettes.

A plurality of storage units 18 are received in the container magazine 11. In the present case, this consists of two part magazines 19 and 20. Each of these part magazines 19, 20 is assigned a vertical conveyor for the storage units 18. The vertical conveyors consist of respective pairs of belt conveyors 21, 22 located opposite one another. These are provided on the outside with drivers or supporting legs 23. Vertical conveying strands 24, 25 of the belt conveyors 21, 22 located opposite one another are aligned in such a way that the supporting legs 23 extend in a common horizontal plane. The storage units 18 rest with edge regions on the supporting legs 23. By means of a mutually coordinated drive of the belt conveyor 21, 22 of a part magazine 19, 20, storage unit 18 resting on the supporting legs 23 can be moved upwards or downwards.

The storage unit 18 can be moved from one part magazine 19 to the other part magazine 20 and in the opposite direction within the container magazine 11. Located for this purpose in the lower region of the container magazine 11 is a cross-conveyor 26. This likewise consists, here, of two conveyor bands 27, 28 with drivers 29 directed outwards. For the transverse transport within the container magazine 11, a storage unit 18 is set down on the cross-conveyor 26, namely on an upper conveying strand. The conveyor bands 27, 28 are arranged at such a distance from one another that the storage units 18 form a projection laterally. This extends respectively in the path of movement of the supporting legs 23. As a result, the storage units 18 can be lifted off directly from the cross-conveyor 26 and lifted into one part magazine 19, 20 or the other. Conversely, storage units 18 can be set down on the cross-conveyor 26 and be conveyed outwards or to the other part magazine.

A transverse transport to the storage unit 18 from one part magazine to the other is also possible in the upper region of the container magazine 11. Here, the storage units 18 are received by a head conveyor 30 and are held movably by members not shown in detail. The storage unit 18 is moved along conveying rails 31, 32, in the present case by a slide 33 movable in the longitudinal direction of the conveying rails 31, 32.

For universal handling of the cigarettes 10 or of the storage units 18, for example for transporting storage units 18 to another packaging machine, a transport vehicle of a special type is provided. This is a container carriage 34 which serves for receiving a plurality of, in the present exemplary embodiment three, storage units 18. For this purpose, the container carriage 34 is provided with a vertical supporting frame 35. Here, this is mounted eccentrically, namely laterally on an underframe 36 equipped with rollers. A telescopically movable supporting piece 37 is mounted so as to be movable up and down the supporting frame 35 acting in the same way as a supporting column. This supporting piece 37 is movable on the supporting frame 36 in the same way as a slide and can be moved, for example, by means of a pressure-medium cylinder (not shown) or also by means of a chain drive. Laterally projecting or overhanging support arms 38 are attached at a distance from one another to the supporting piece 37. The supporting arms 38 are made fork-shaped here, that is to say with two legs which are arranged at a distance from one another and on which the storage units 18 rest.

By means of the container carriage 34 thus designed, a plurality of storage units 18 can be simultaneously extracted from or introduced into the container magazine 11. The distances between the supporting arms 38 correspond to the distances between successive supporting legs 23 of the belt conveyors 21, 22. By means of the overhanging supporting arms 38, the container carriage 34 can be moved up to the container magazine 11 in such a way that the storage units 18 resting on the supporting arms 38 can be transferred in the correct position onto pairs of supporting legs 23 located opposite one another or be lifted off from these. For setting down, the supporting arms 38 are lowered as a result of a downward movement of the supporting piece 37, so that the storage units 18 are set down on the supporting legs 23. For the extraction of storage units 18, the procedure takes place correspondingly in reverse.

The filling and emptying of the storage units 18 or containers 12 takes place, here, in the region of the container magazine 11. This is equipped with the filling station 39. A filling member 40 is located in a region between the two part magazines 19, 20, specifically in the lower region of the container magazine 11. This arrangement is such that the containers 12 are filled with cigarettes 10 from below, namely via the bottom wall 17. The emptying of the containers 12 likewise takes place downwards, that is to say via the bottom wall 17.

In the exemplary embodiment illustrated, for filling or emptying the containers 12, a storage unit 18 is conveyed in steps by the cross-conveyor 25 through the filling station 39 or above and beyond the filling member 40. The individual containers 12 pass successively into a position above the filling member 40 and are filled or emptied from below. The cross-conveyor 26 is intermittently driven correspondingly.

Figure 5:
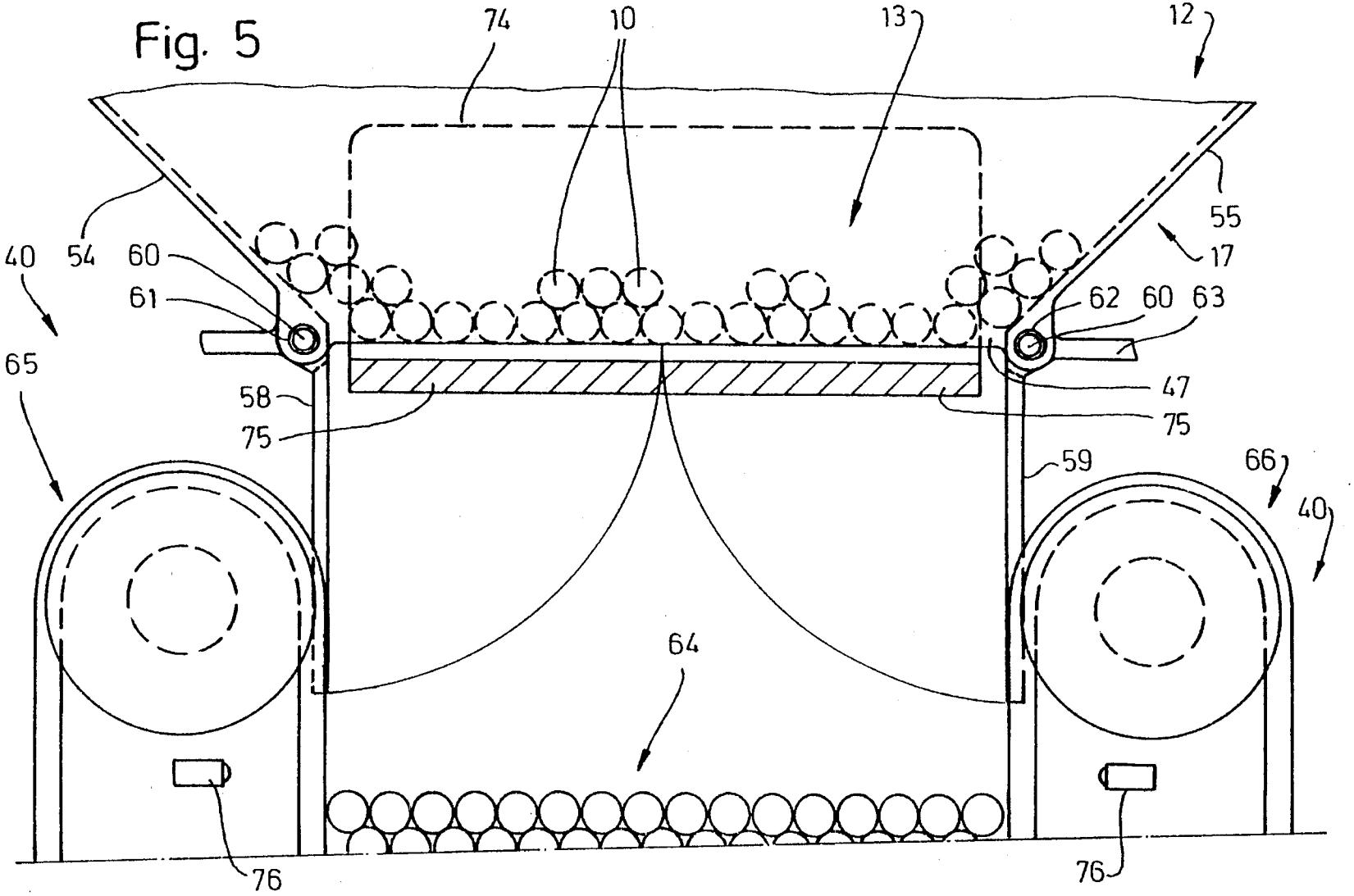
FIG. 5 shows a (lower) detail of a container for a cigarette stock on a greatly enlarged scale, partially in section.
Figure 6:
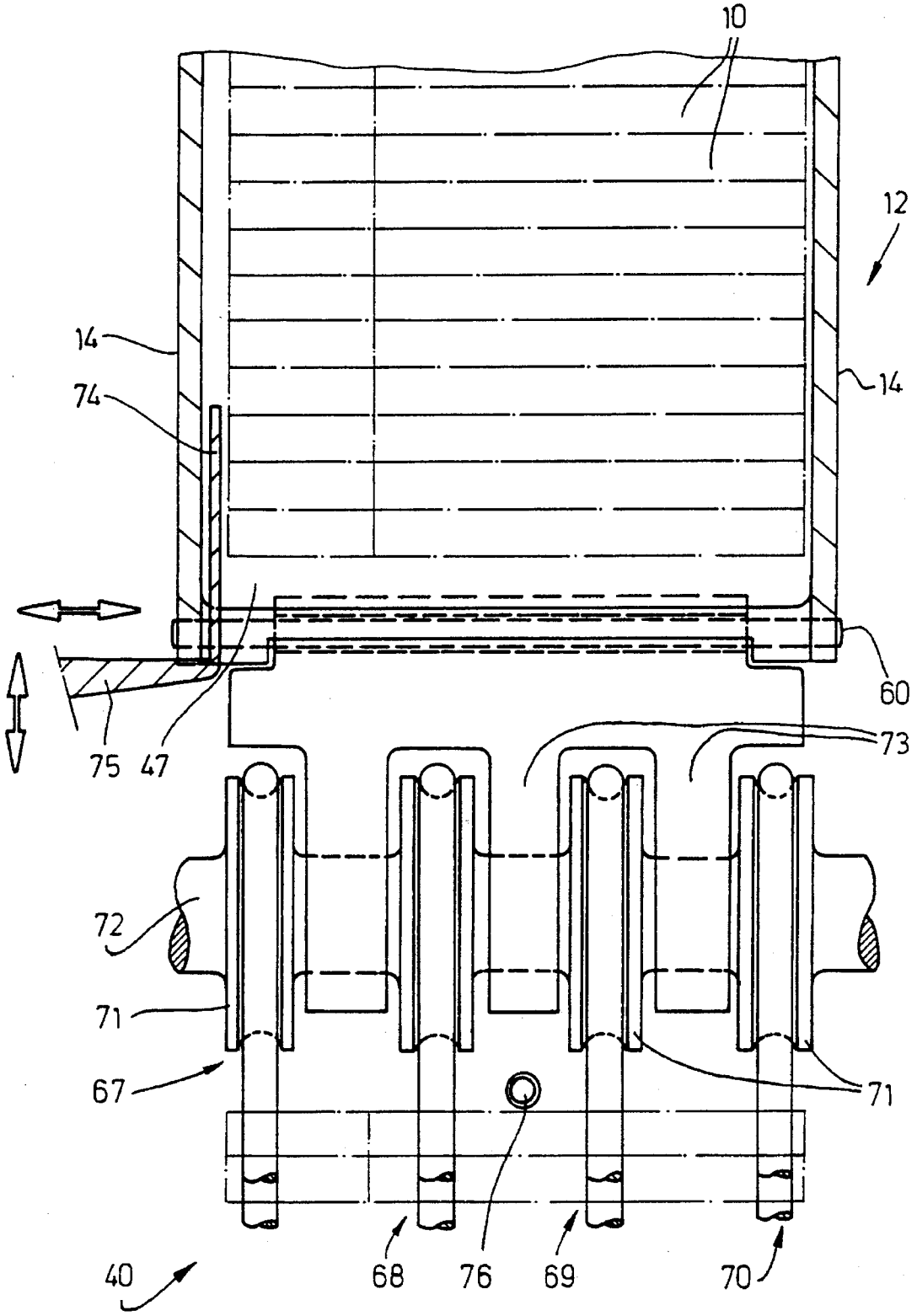
FIG. 6 shows a representation offset at 90° or a transverse view of the detail according to FIG. 5.

The cigarettes 10 are fed to the container magazine 11 by a cigarette conveyor 41. This is designed in a known way and consists of upper and lower conveyor bands, between which a cigarette stream is conveyed continuously. The cigarette conveyor 41 leads to a distributor unit 42. Here, a branch 43 leads downwards into a region below the plane of movement of the lower storage unit 18. A transverse track 44 leads in the region of the cross-conveyor 26, namely between its strands, to the filling member 40 which, here is an upwardly directed track of the cigarette conveyor (FIGS. 5 and 6).

A cigarette conveyor, namely a discharge conveyor 45, leads from the distributor unit 42 to the packaging machine or to another consumer for the cigarettes. Here, the discharge conveyor 45 runs in the axis of the cigarette conveyor 41.

Furthermore, there follows, in the region of the distributor unit 42, a cigarette buffer 46. This is likewise designed as a cigarette conveyor and, for compensating purposes, can received limited quantities of cigarettes for a short time. The cigarette buffer 46 extends above the discharge conveyor 45 in the region between the part magazines 19, 20.

During the filling of the containers 12, the cigarettes delivered by the cigarette conveyor 41 are deflected, in the region of the distributor unit 42, into the branch 43 leading downwards, then into the transverse track 44 and finally, via the upwardly directed filling member 40, into the correspondingly positioned container 12. However, cigarettes can also be conveyed further, bypassing the container magazine 11, to the packaging machine via the discharge conveyor 45. During the emptying of the containers 12, the cigarette stream runs correspondingly in reverse.

Each container 12 is provided, in the region of the bottom wall 17, with a central filling orifice 47. The filling member 40 is connected to this for the purpose of the filling or emptying the container 12.

To make the filling operation and the emptying of the containers 12 easier, lead or guide members 48, 49 can be introduced into the container 12. In the exemplary embodiment according to FIG. 3, the guide members 48, 49 are moved into the interior of the container 12 via the bottom wall 17. For this purpose, the bottom wall is provided, outside the region of the filling orifice 47, with recesses for the passage of the guide members 48, 49. In the exemplary embodiment shown, slots 50, 51 extending in the longitudinal direction of the bottom wall 17 are provided. Webs 52 forming the guide members 48, 49 pass through these slots 50, 51.

Figure 3:
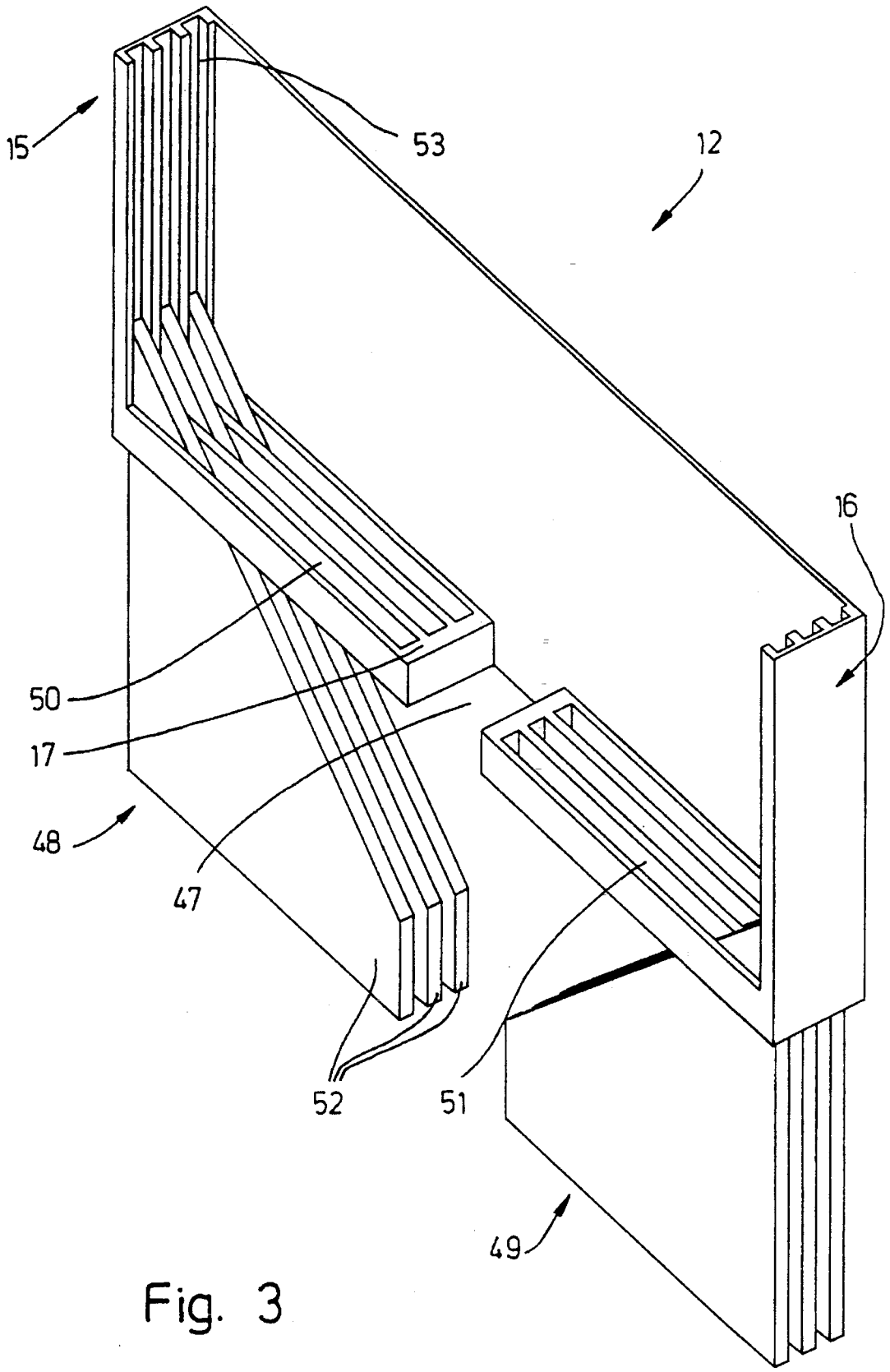
FIG. 3 shows a simplified perspective representation of an individual container for a cigarette stock.

In the exemplary embodiment of FIG. 3, there are provided two guide members 48, 49 which fill primarily lower corner regions of the container 12 located at the bottom and which thereby bring about a limitation of the space for the cigarettes 10, the said limitation being funnel-shaped or leading in a converging manner to the filling orifice 47. Each of the two guide members 48, 49 consist, here, of three webs 52 which pass through three associated slots 50, 51. In an upper end position, a guide member 48, 49 extending approximately from the filling orifice 47 as far as the upper edge to the side walls 15, 16 is produced in the container 12. The latter consequently has a funnel-shaped free inner space which makes the filling operation and also the emptying operation easier. The guide members 48, 49 are gradually retracted out of the container 12, specifically downwards through the bottom wall 17, with an increasing degree of filling of the container 12. Conversely, during emptying, the guide members 48, 49 are gradually introduced into the container 12. For better positioning, guide grooves 53 for the webs 52 are formed on the inside of the side walls 15, 16.

In an advantageous alternative of the container 12, the guide members are introduced into the container 12 not via the bottom wall 17, but from the sides, that is to say via the side walls 15, 16. In this version, corresponding slots or other recesses are arranged in the side walls 15, 16. The horizontally displaceable guide members can be designed similarly to those of FIG. 3. In this alternative, the bottom wall 17 is made continuous, with the exception of the filling orifice 47, that is to say without slots 50, 51 or other orifices.

The guide members 48, 49 are expediently arranged in a stationary manner solely in the region of the filling station 39. The actuation of the guide members 48, 49 can take place by suitable means, such as pressure-medium cylinders or mechanical gears.

To make it easier to fill and empty the containers 12, these can have fixed built-in fittings as guide members which guide a cigarette stream in the direction of the filling orifice 47 or away from this.

Figure 4:
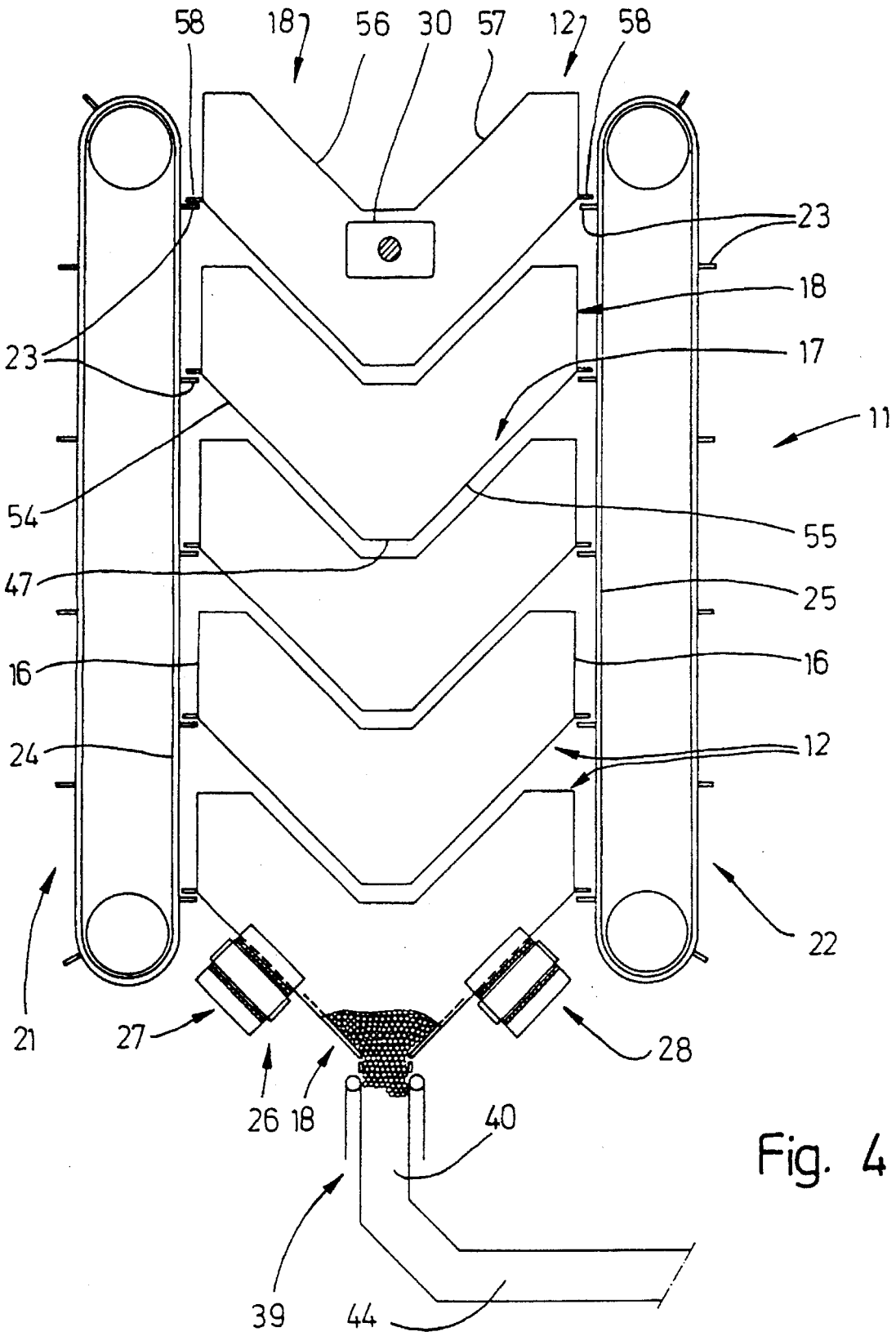
FIG. 4 shows a partially sectional side view of an alternative design of a container for a cigarette stock in a container magazine.

FIG. 4 shows a solution based on specially designed containers 12. These are designed with a funnel-shaped bottom wall 17, namely with two wall legs 54 and 55 leading in the direction of a (central) filling orifice 47. The wall legs 54, 55 directly limit the filling orifice 47 with their lower edges.

In this version, the top side of the container 12 can be designed in a conventional way. With a space-saving nested positioning of the containers 12 having a V-shaped bottom wall 17, the top side is likewise made V-shaped correspondingly, with top sides 56, 57 converging towards one another. The container 12 can be closed in this region, but at least with grid-like covers which allow filling up to the upper edge of the V-legs.

In the exemplary embodiment of FIG. 4, the side walls 15, 16 are provided with extensions 58. These are directed sideways and can be grasped by the supporting leg 23 of the vertical conveyors of the container magazine 11. Thus, even when the containers 12 have a V-shaped design, a container magazine 12 is possible in the way described. In this solution, the lower cross-conveyor 26 consists of two conveyor bands 27, 28 extending in inclined planes. Their upper conveying strand bears against the oblique wall legs 54, 55 of the bottom wall 17. As a result, storage units 18 consisting of containers 12 according to FIG. 4 can be moved and treated in the same way as in the exemplary embodiment of FIGS. 1 and 2. For the transverse transport of the upper storage units 18, in this exemplary embodiment the head conveyor 30 is represented as a piston rod of a pressure-medium cylinder which executes the transverse displacement from one part magazine to the other.

In the various embodiments, the containers 12 are designed in a special way in the region of the filling orifice 47. Reference is made for this purpose to FIGS. 5 and 6. The details shown there relate to a container 12 in the version according to FIG. 4, that is to say with a funnel-shaped or V-shaped bottom wall 17 having wall legs 54, 55 which limit the filling orifice 47 laterally by means of the lower edges.

The filling orifice 47 can be closed by a closing member. In the exemplary embodiment illustrated, this purpose is served by closing flaps, namely two closing flaps 58, 59 mounted on the lower edges of the wall legs 54, 55 of the bottom wall 17. In the closing position, each closing flap 58, 59 covers one half of the filling orifice 47. The closing flaps 58, 59 are mounted in rotary bearings 61, 62 of the bottom wall 17 by means of rotary bolts 60. Actuation, namely the transmission of pivoting movements, takes place via a transversely projecting extension 63, on which a suitable actuating member, for example a pressure-medium cylinder, acts.

In the opening position, the closing flaps 58, 59 are directed downwards, so that a distance of 90° is covered between the closing position and opening position. In the opening position (FIGS. 5 and 6), the closing flaps 58, 59 serve as a lateral guide for a cigarette stream 64 which is transported to the filling orifice 47 by the filling member 40.

The filling member 40 consists, here, of vertical endless conveyors 65, 66 located opposite one another. Each endless conveyor 65, 66 itself consists of a plurality of individual conveyors 67, 68, 69 and 70 located next to one another.

Each individual conveyor 67 . . . 70 is formed from endless belts made of round material (rubber or plastic). Each individual conveyor 67 . . . 70 runs via a deflecting pulley 71. The deflecting pulleys 71 are arranged at a distance from one another on a common shaft 72. The cigarettes 10 are conveyed transversely and axially and, at the same time, bear on the mutually confronting conveying strands of the individual conveyors 67 . . . 70 on both sides of the filling member 40.

The filling member 40 terminates at a distance below the container 12 or the filling orifice 47. In the interspace obtained, the cigarette stream 64 is limited laterally by the closing flaps 58, 59 pivoted into a vertical position. These extend into the region of the individual conveyors 67 . . . 70.

In the exemplary embodiment illustrated, the closing flaps 58, 59 are made comb-like in the lower region (in a vertical position). Prong-like projections 73 penetrate into the region between the adjacent individual conveyors 67 . . . 70. In the present exemplary embodiment, there are three projections 73 with a corresponding number of gaps between the individual conveyors 67 . . . 70. This guarantees a step-free continuous guidance for the cigarette stream 64 over the entire height as far as the filling orifice 47.

Located within the container 12 and above the filling orifice 47 is a stop member for temporarily fixing cigarettes 10 located at the bottom, during the closing of the filling orifice 47. In the exemplary embodiment shown, a pressure plate 74 is arranged in the region of the filling orifice 47. The pressure plate 74 extends approximately over the entire width of the filling orifice 47. The pressure plate 74 is pressed against the confronting end faces of the cigarettes 10. A number of cigarettes 10 corresponding to the size of the pressure plate 74 is thereby fixed by clamping against the opposite front wall 14. The cigarettes 10 consequently cannot fall out of the container 12 downwards. The closing flaps 58, 59 can then be moved into the closing position. The pressure plate 74 is subsequently relieved. For the actuation of the latter, a transverse leg 75 is arranged on the lower edge of the pressure plate 74. This transverse leg 75 emerges sideways from the container 12 and serves for actuating the pressure plate 74. Moreover, the latter is also movable up and down and is located only in the region of the filling station 39 in the particular container 12 being processed.

Because the cigarettes 10 are fixed in the lower region of the container 12, a special closing operation can be put into practice. After the filling of the container 12 and the fixing of the cigarettes by the pressure plate 74, by means of an opposed drive of the endless conveyors 65, 66, the cigarette stream 64 is moved back or lowered in the filling member 40 to a level outside the range of movement of the closing flaps 58, 59. The control takes place via a light barrier generated by sensors 76. In the lowered position of the cigarette stream 64, as shown in FIG. 5, the closing flaps 58, 59 can be moved freely.

Figure 7:
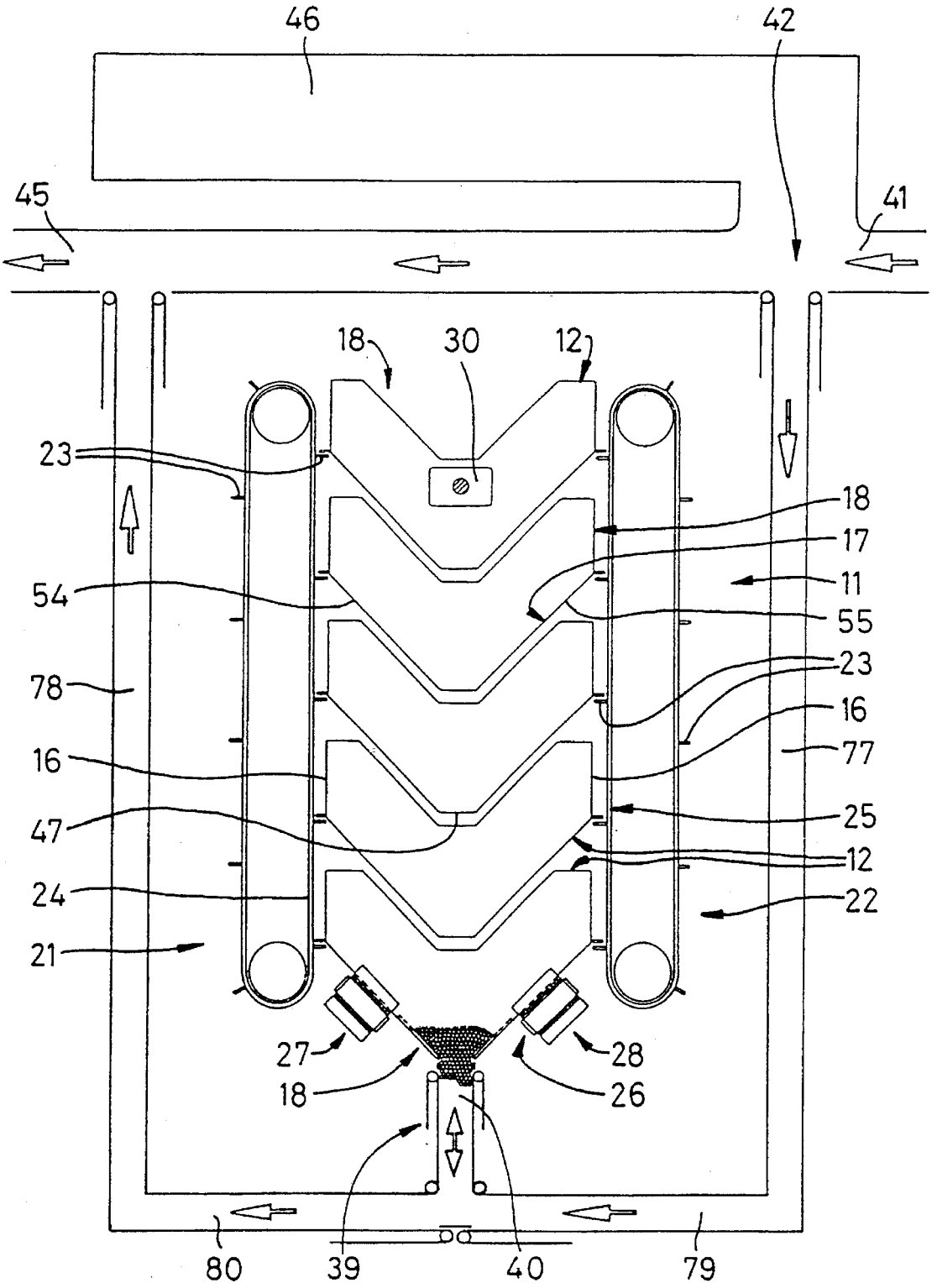
FIG. 7 shows a partially sectional side view of an alternative for feeding cigarettes to a container magazine according to FIG. 4 and for conveying them away.

An alternative for feeding cigarettes 10 for filling the containers 12 and for conveying them away for emptying these is shown in FIG. 7. Each container magazine 11 is assigned two separate conveyors, namely a first branch 77 solely for filling the containers 12, on the one hand, and a second branch 78 solely for emptying the containers 12, on the other hand. The branches 77 and 78 are respectively arranged on opposite sides of the container magazine 11.

The first branch 77 leads downwards from the distributor unit 42 into the region below the planar movement of the lower storage unit 18. There follows here a first transverse track 79 which leads to the filling member 40. By means of the first branch 77, the cigarettes 10 can be conveyed solely in a downward direction. By means of the first transverse track 79, the cigarettes 10 are transported solely from the branch 77 to the filling member 40. The branch 77 and the transverse track 79 therefore serve purely for feeding the cigarettes 10 to the filling member 40 and consequently for filling the container 12. Accordingly, conveyor bands of the branch 77 and of the transverse track 79 can be driven in only one direction.

The second branch 78 leads from the region below the plane of movement of the lower storage unit 18 upwards to the discharge conveyor 45. A second transverse track 80 leads from the filling member 40 to the second branch 78. By means of the second transverse track 80, the cigarettes 10 are transported solely from the filling member 40 to the second branch 78. By means of the second branch 78, the cigarettes 10 can be conveyed solely in the upward direction from the second transverse track 80 to the discharge conveyor 45. The second branch 78 and the second transverse track 80 therefore serve purely to convey the cigarettes 10 away from the filling member and consequently for emptying the container 12. Accordingly, the conveyor bands of the two branches 78 and the second transverse track 80 can also be driven in only one direction.

In the present case too, the filling member 40 serves both for the filling and for the emptying of the containers 12. The endless bands 65, 66 of the filling member 40 can accordingly be driven in both directions.

What is claimed is:

1. An apparatus for transport and stocking of cigarettes (10) in a plurality of containers (12) which are arranged next to one another, and which are adapted to be filled or emptied in a filling and emptying station (39) by a filling and emptying member (40), wherein:

a) the plurality of containers (12) are fixedly connected to one another and form a rigid storage unit (18) defining a plurality of chambers that are separated from one another by separating walls (14) which are vertical front walls of respective containers;

b) the containers (12) have a width transverse relative to the separating walls (14) that corresponds to a length of the cigarettes (10); and c) the containers (12) have a rigid bottom wall (17) in which is located an orifice (47) for filling and emptying the container (12);

said apparatus comprising:

d) a container magazine (11) for storing a plurality of the storage units (18), and comprising of at least two part magazines (19, 20) which are arranged one behind another, and each of which stores a plurality of storage units (18) vertically arranged one on top of another;

e) a vertical belt conveyor (21, 22) adjacent each of the part magazines (19, 20) for transporting storage units (18) in a vertical direction; and f) a horizontal transverse conveyor (26), interconnecting the part magazine, for conveying the storage units (18) to and fro between the part magazines (19, 20), g) said transverse conveyor (26) successively feeding the rigid storage units (18) to the filling and emptying station (39) so that the containers (12) of a respective storage unit (18) can be filled or emptied individually and successively.

2. The apparatus as claimed in claim 1, wherein there are two separate conveyors, namely a first branch (77) solely for filling the containers (12), on the one hand, and a second branch (78) solely for emptying the containers (12), on the other hand, which are respectively arranged on opposite sides of the container magazine (11).

3. The apparatus as claimed in claim 1, wherein the container magazine (11) is assigned a transport appliance movable on rollers, namely a container carriage (34) having vertically adjustable carrying arms (38) which are arranged at a distance from one another corresponding to the distance between the storage units (18) arranged one above the other in the container magazine (11) and which each serve for receiving a storage unit (18).

4. The apparatus as claimed in claim 3, wherein the carrying arms (38) are mounted, as overhanging arms projecting on one side, on a carrier piece (37) of the container carriage (34), the said carrier piece being movable up and down.

5. The apparatus as claimed in claim 1 wherein each individual container (12) has at least one of said vertical front walls (14), narrow side walls (15, 16) and said bottom wall (17) which is stationary, wherein said orifice (47) is for introducing cigarettes (10) into the container (12) and for emptying the latter, and wherein downwardly converging or funnel-shaped guide faces leading to the orifice (47) are formed inside the container (12).

6. The apparatus as claimed in claim 5, wherein the stationary bottom wall (17) of the container (12) is made V-shaped or funnel-shaped, in such a way that wall legs (54, 55) of the bottom wall (17) lead to the filling orifice (47) and limit these.

7. The apparatus as claimed in claim 6, wherein the containers (12) are as a whole of V-shaped design in vertical section, in such a way that containers (12) arranged one above the other can be nested positively in one another as said storage units (18) are arranged one above the other.

8. The apparatus as claimed in claim 5, further comprising separate guide members (48, 49) for the cigarettes, wherein, during a phase of the filling and/or emptying of each container (12), said separate guide members (48, 49) for the cigarettes (10) project into the container (12) via an at least partially open side thereof and is gradually movable out of the container (12) in conformity with a filling or emptying operation.

9. The apparatus as claimed in claim 8, wherein the guide members (48, 49) are triangular with oblique guide faces converging toward the filling orifice (47).

10. The apparatus as claimed in claim 8 or 9, wherein the guide members (48, 49) have a plurality of webs (52), and wherein the bottom wall (17) has a plurality of slots (50, 51) said apparatus further comprising means for introducing into, and retracting from, the container (12) said guide members (48, 49) in the filling station (39).

11.The apparatus as claimed in claim 1, wherein each container (12) has at least one of said vertical front walls (14), narrow side walls (15, 16) and said bottom wall (17); wherein said orifice (47) is for introducing cigarettes (10) into the container (12) or for emptying the latter; wherein there are two closing flaps (58, 59) for closing the orifice (47), each flap covering half of the orifice (47); and wherein there are means (63) for pivoting the closing flaps (58, 59) between a closing position and a vertical or downwardly pointing opening position.

12. The apparatus as claimed in claim 11, wherein, in the opening position, the closing flaps (58, 59) are adjacent to endless conveyors (65, 66) of the vertical filling and emptying member (40) underneath the orifice (47), and bridge an interspace between the member (40) and the orifice (47).

13. The apparatus as claimed in claim 12, wherein the closing flaps (58, 59) are comb-like in a region which is lower in the opening position, and have a plurality of projections (73) which are arranged at a distance from one another and which penetrate into interspaces between individual conveyors (67, 68, 69, 70) of the endless conveyors (65, 66).

14. The apparatus as claimed in claim 11, wherein the cigarettes (10) in the filling and emptying member (40) are lowered in order to close the orifice (47), in such a way that the closing flaps (58, 59) are freely movable into the closing position, whilst lower cigarettes in the container (12) are fixed above the orifice (47) by clamping to prevent their falling out of the containers.

15. The apparatus as claimed in claim 14, further comprising a pressure plate (74), wherein the lower cigarettes (10) in the container (12) are pressed by said pressure plate (74), against the vertical front wall (14) of the container (12), in order to prevent the cigarettes (10) from falling out of the container (12).

16. The apparatus as claimed in claim 1, further comprising a horizontal head conveyor (30) also for transporting the storage units (18) to and fro between the part magazines (19, 20).

17. The apparatus as claimed in claim 16, wherein the transverse conveyor (26) is arranged in a lower region of the container magazine (11), and the head conveyor (30) is arranged in an upper region of the container magazine (11), such that a respective lowermost storage unit (18) of a part magazine (19, 20) is deposited onto the transverse conveyor (26), and a respective uppermost storage unit is transferred to the head conveyor (30).

18. The apparatus as claimed in claim 17, wherein the filling station (39) is centrally located between the part magazines (19, 20) and in a region adjacent the transverse conveyor (26).

19. The apparatus as claimed in claim 17, wherein a cigarette conveyor (41) for transporting the cigarettes (10) from a production machine to the container magazine (11) or to the filling station (39) and a discharge conveyor (45) for transporting the cigarettes (10) to a packaging machine are arranged in a region between the two pan magazines (19, 20).

20. The apparatus as claimed in claim 19, wherein there leads downwards from the cigarette conveyor (41), outside a region of the storage units (18), a branch (43), to which is connected in one plane, below the lowermost storage units (18), a transverse track (44) which leads to the upwardly directed filling and emptying member (40) the cigarettes (10).

21. The apparatus as claimed in claim 1, wherein said vertical belt conveyor has at least two pairs of mutually confronting conveying belts (21, 22) which are commonly driven in an upward or downward direction, each of the conveying belts having mutually confronting conveying strands (24, 25) which are arranged in pairs on opposite sides of the storage units (18), and which have carrying legs (23) on which edges of the storage units rest.

* * * * *